US006883454B2

(12) United States Patent
Blackmore

(10) Patent No.: US 6,883,454 B2
(45) Date of Patent: Apr. 26, 2005

(54) WATERCRAFT ROLL-ON SYSTEM

(75) Inventor: William R. Blackmore, Bloomington, MN (US)

(73) Assignee: St. Croix Marine Products, Inc., Bloomington, MN (US)

( * ) Notice: Subject to any disclaimer, the term of this patent is extended or adjusted under 35 U.S.C. 154(b) by 0 days.

(21) Appl. No.: 10/306,189

(22) Filed: Nov. 27, 2002

(65) Prior Publication Data

US 2004/0099198 A1 May 27, 2004

(51) Int. Cl.[7] ..... B63B 35/40
(52) U.S. Cl. ..... 114/259; 114/366
(58) Field of Search ..... 114/258, 259, 114/344, 362, 364, 365, 366, 375; 405/1, 2, 3

(56) References Cited

U.S. PATENT DOCUMENTS 4,103,926 A * 8/1978 Johnston et al. ..... 280/414.1
5,636,587 A * 6/1997 Klimowicz ..... 114/259
5,810,546 A * 9/1998 Schmoling ..... 414/538
5,884,885 A * 3/1999 Schmidt, Jr. ..... 248/346.01
5,904,113 A * 5/1999 Slikkers ..... 114/259
6,089,174 A * 9/2000 Slikkers et al. ..... 114/259
6,125,783 A * 10/2000 Shimmell et al. ..... 114/343
6,289,837 B1 * 9/2001 Stetzel ..... 114/259
6,592,291 B1 * 7/2003 Foxwell ..... 405/1

* cited by examiner

*Primary Examiner*—Andrew D. Wright
(74) *Attorney, Agent, or Firm*—Dennis A. Gross, The Hill Firm

(57) ABSTRACT

An auxiliary watercraft roll-on, roll-off cradle system removably attachable to an aft platform of a boat consists of a first set of rollers tiltably attached to the platform and a second set of supporting rollers removably attachable to the platform.

11 Claims, 1 Drawing Sheet

WATERCRAFT ROLL-ON SYSTEM

This invention relates to auxiliary watercraft support structures and more particularly to a roll-on, roll-off auxiliary watercraft cradle system.

BACKGROUND OF THE INVENTION

Larger boats, and particularly pleasure craft, often times are provided with a platform type structure, sometimes called a swim platform, which extends aft of the transom of the boat at the stern slightly above the water line. It has become popular to use these platforms for storing auxiliary watercraft such as tenders, jet skies and the like.

Since such auxiliary water craft can be heavy and extremely awkward to lift into and out of the water, various loading aids have been provided. Such loading aids range from auxiliary davits or cranes carried by the boat to elevatable and submergible swim platforms. Such crane devices and movable swim platforms are generally permanent attachments to the boat, are relatively unsightly and are expensive.

Additionally in order to secure the auxiliary watercraft in place on the platform, cradling must be provided. Because the cradle is used when the boat is under way, the cradle must be secured to the platform. Such cradling is unsightly when the auxiliary watercraft is not in place, interferes with the normal use of the platform and can create a hazard to individuals moving about on the platform.

It would therefore be an advance in the art to provide an alternative system for moving personal watercraft from the water to a aft platform mounted cradle which could be adapted to use on existing platforms and which provides a secure but removable cradle.

SUMMARY OF THE INVENTION

My invention provides a roll-on, roll-off cradle member which is removably carried on a boat's platform and which readily transforms from a watercraft-supporting cradle to a collapsed more compact, removable structure. The cradle is equipped with pins receivable in socket openings in the swim platform in the manner of a shot pin to removably. The cradle is collapsible such that it can be opened to a full cradle length for receipt of a watercraft, or collapsed to a smaller member leaving large areas of the platform free for other uses and is entirely and quickly removable from the platform.

A second roller member is carried at an edge of the platform and consists of a platform secured mounting shoe and a tilting multi-roller carrier mountable to the shoe. With the roller carrier in position partially overlying an end or side of the swim platform and with the cradle member in position on the platform and extended into its cradled position, a watercraft can be easily brought onto the platform and onto the cradle. The watercraft is first brought into contact with the outermost roller at the leading edge or bow of the watercraft with the roller carrier tilted to loading-unloading position. The watercraft may be attached to a cable which may in turn be part of a block and tackle or be connected to a winch, or in the case of lighter weight watercraft merely adapted to be pulled. By drawing in the cable, the watercraft will ride up on the roller assembly which will be tilted with respect to the swim platform to provide a slope from a first roller upwards to a second roller. As the watercraft continues to be drawn onto the platform, its bottom will ride up on the rollers of the roller carrier. Further movement of the watercraft onto the platform will result in the roller carrier pivoting to a horizontal position to deposit the bow section of the watercraft onto cradle carried rollers. The watercraft can then be drawn horizontally along the cradle substantially parallel to the swim platform until it is in position on the cradle whereupon it may be secured.

To unload the watercraft from the swim platform, all that will be necessary is to push it on the rollers of the cradle and the carrier until the weight of the watercraft causes the carrier to tilt thereby lowering the watercraft into the water. Generally at that point the weight of the watercraft will cause it to continue to self-unload.

The roller carrier is easily removable from the mounting shoe. The cradle may be equipped with outboard rollers adjacent the end of arms removably attachable to a frame of the cradle with the arms provided with projecting angle adjustments. The arms, outboard rollers and cradle rollers can be chosen to properly cradle a chosen watercraft.

The cradle is formed in two sections, a main or base section and a second section connected to the base section of the cradle. The second section can be rotatably folded back or otherwise collapsed onto the base section to provide a compact structure. That structure can be removed from the swim platform when desired simply lifting it from the socket openings.

It is therefore an object of this invention to provide a collapsible, removable auxiliary watercraft cradle for use on a boat.

It is another object of the invention to provide a boat's platform mountable auxiliary watercraft cradle which is attachable to and detachable from the platform with a minimal amount of effort.

It is a further object of this invention to provide a roll-on, roll-off auxiliary watercraft cradle system employing a platform edge mounted set of rollers which can tilt with respect to the platform.

It is an object of this invention to provide a roll-on, roll-off device to be detachably carried on the aft platform of a boat for positioning auxiliary watercraft wherein the device includes a tiltable roller assembly adjacent an edge of the platform and a cradle carried by the platform positioned to support an auxiliary watercraft over the platform, the cradle being collapsible and removable from the platform.

These and other objects of this invention will be apparent from the following description of a preferred embodiment representing one specific structure adapted to carrying out the teachings of this invention. It will be apparent that the objects of this invention can be achieved by other embodiments.

BRIEF DESCRIPTION OF THE DRAWINGS

The FIGURE is an expoded view of the roll-on, roll-off cradle system of this invention.

DESCRIPTION OF THE PREFERRED EMBODIMENT

Figure 1:
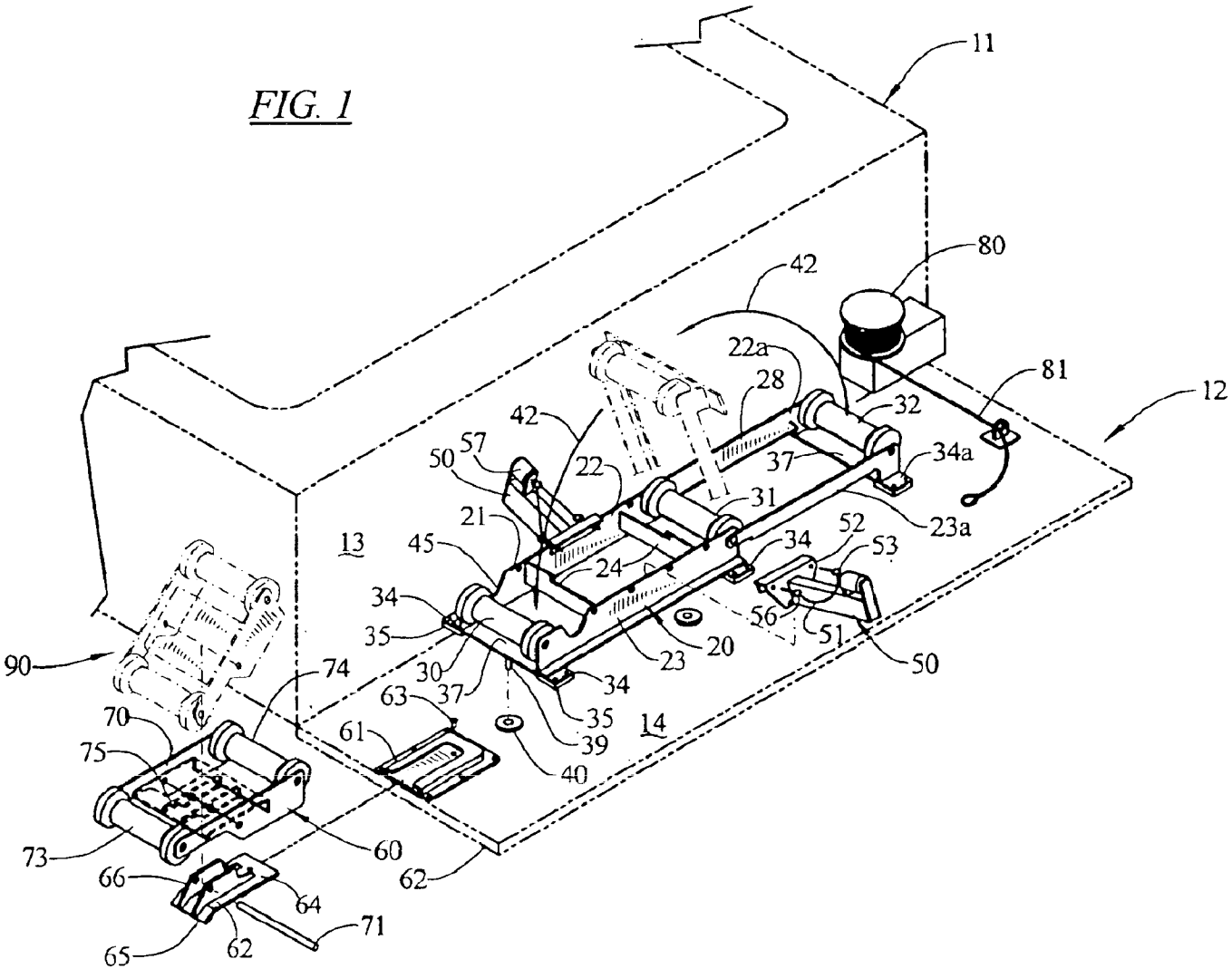

As shown in the FIGURE a boat 11 is provided with an aft, or swim, platform 12 projecting from the transom 13. The surface 14 of the platform will lie a distance above the waterline. Pleasure craft and sport boats commonly are equipped with such platforms. Auxiliary watercraft such as dingies, jet boats, jet skies, PWCs and the like are frequently carried on such platforms for out of water storage and for transportation with the boat. Since such watercraft may be quite heavy, moving the craft from the water to the platform can be difficult and require the aid of auxiliary devices. In order to secure the watercraft in position on the platform, a cradle structure is normally provided attached to the platform. Such cradle structures, or chocks, must be secured to the platform so as to prevent accidental displacement of the watercraft and cradle.

As shown in the figure, a cradle device 20 includes a first frame member 21 having parallel rails 22 and 23 spaced apart and interconnected by struts 24. Adjacent one end of the rails is a first roller 30 rotatably carried by the rails and adjacent a second end a second roller 31 is similarly mounted. The rollers may be configured to the bottom of the watercraft to be supported to provide self-centering and lateral support.

The rails are provided with support feet 34 which may have pads 35 which protect the surface 14 of the platform.

The frame has structural members 37 which, in the embodiment illustrated are positioned to underline the rollers 30 and 31 with the members extending between the rails. Attached to the bottom of the members 37 are locating pins 39 which are receivable in sockets 40 carried by the platform 12. The pins 39 may preferably be of the type which when received in the socket will be removably retained therein by a friction means. A typical type of such friction means would be a spring-backed member protruding part way from the pin receivable in a groove in the socket. Such pins lock in the socket but are releasable from the socket upon a sufficient withdraw force.

A second frame 28 is pivotally attached to the frame 21 and similarly includes rails 22*a* and 23*a* which, as shown, are pivotally attached to rails 22 and 23. Frame 28 includes at least one roller 32 rotatably carried by the rails above a structural member 37. The frame 28 is equipped with feet 34*a* which again may carry pads. The rails 22*a* and 23*a* are spaced apart a distance greater than the rails 22 and 23 so that when the frame 28 is folded back, by being rotated in the direction of the arrows 42, the rails 22*a* and 23*a* will lie outside of the rails 22 and 23. The roller 32 may be received in notches 45 provided in the rails 22, 23.

The cradle is also provided with removable outriggers 50 which are attachable to and removable from the rails 22, 23. As illustrated, the outriggers 50 include arms 51 which are attached to a mounting bracket 52 which is U-shaped at the top to be slid over the top of the rails 22, 23 resting on top of the rail at the bight of the U. Removable locking pins 53 may be carried by the outriggers and are extendable through openings in the bracket 52 and corresponding openings in the rail to lockably position the outriggers at the rail. The pins may be attached to the outriggers by cables. An adjusting nut 56 is threadably received through the bracket 52 beneath the pin attachment points and can be used to adjust the up angle of projection of the arms 51 from the rail. The arms terminate in rollers 57. The outriggers permit the cradle to be adjusted to various personal watercraft bottom shapes and to provide a more secure cradling of the watercraft.

In the embodiment illustrated, the outriggers are removable by withdrawing the pins, which may be of the locking pin variety described above. Thereafter the brackets may be received on the cross struts 24 which may be notched to receive a bracket. This stores the outriggers between the rails when it is desired to collapse and remove the cradle. It will be appreciated then that the cradle when in a watercraft storage position will be securely held to the platform 24 through the pins 39 and sockets 40 and will extend substantially along the width of the platform, the cradle being dimensioned both with respect to the length of the personal watercraft and the side-to-side dimension of the platform. The outriggers are similarly dimensioned with respect to the watercraft to be held in the cradle and by adjusting the spacing between struts 24, longer or shorter armed outriggers may be utilized and stored. Upon removal of the outriggers from the rails, and the attachment of the outriggers to the struts, the cradle can be folded back upon itself and easily removed from the platform, leaving the platform with only the cradle receiving sockets which can be flush with the platform surface.

In order to aid in moving a watercraft from the water to the cradle, a roller carrier 60 is provided. The roller carrier cooperates with a shoe 61 attached to the platform adjacent an edge 62. The shoe may have a U-shaped groove opening to receive a carrier support inserted into the shoe 61. The carrier support 62 has a first planer bottom section 64 having at one end thereof a downturned lip 65. A pair of upstanding rails 66 project above the plate 64 and lip. The carrier support is dimensioned with respect to the shoe such that the downturned lip 65 extends beyond the edge of the platform. A roller carrier 60 is pivotally carried by the carrier support and is attached thereto through a pivot axle 71. The roller carrier has parallel rails 70 equipped with rollers 73 and 74 adjacent the ends of the rails. Internal bracing members 75 between the rails and parallel to the rails provide structural rigidity to the carrier and form a pivot connection with the axle 71.

The roller carrier being pivotally connected to the carrier support can tilt from a horizontal position where the rollers are substantially parallel to the surface of the platform and aligned with the rollers of the cradle to a downwardly angled position as illustrated at 90, where the roller 73 lies below the surface 14 of the platform where the roller 74 is elevated from that surface. This allows the roller 73 to be brought close to the waterline so as to be easily engaged by the under surface of a watercraft adjacent to its bow. Drawing the watercraft towards the platform will cause it to ramp upwardly first due to contact with roller 73 and then to contact with roller 74. This effectively begins to raise the watercraft out of the water to bring its bottom up to the level of the platform and cradle. Continued movement of the personal watercraft towards the cradle will result in a pivoting of the roller carrier as more and more of the weight of the watercraft extends over the platform. The roller carrier will eventually pivot back down with the plane of the rollers parallel to the platform depositing the forward portions of the watercraft being loaded onto the cradle roller 30. After the watercraft has been positioned properly with respect to the cradle and the roller carrier, it can be secured by standard means such as strapping. The weight of the watercraft on the cradle and roller carrier will tend to keep them properly in contact with and supported by the platform such that the locking pins locking the cradle to the sockets and the roller carrier to the shoe are assisted in securing the cradle and shoe to the platform.

As illustrated, in order to accommodate the use of the roll-on, roll-off system of this invention, if desired a powered winch 80 can be provided with a cable 81 which can be attached to a standard fitting at the bow of the personal watercraft.

It will be understood that the watercraft can be received solely on the cradle if desired. However in most instances the watercraft, when secured will rest on both the cradle and the roller carrier. If the watercraft does not rest of the roller carrier, then that roller carrier may be removed during travel.

Relaunching the watercraft from the cradle will be very simple since the rollers provide ease of movement of the watercraft generally longitudinally of the cradle. As the watercraft is moved from the cradle to a position more supported on the roller carrier, the roller carrier will again tilt to deposit the watercraft in the water.

It will therefore be understood from the above that this invention provides a roll-on, roll-off auxiliary watercraft cradling device for attachment to the aft platform of a boat. The cradle device includes a stationary cradle assembly having a plurality of parallel rollers carried by a frame removabely attached to the platform, the frame having detachably carried outboard rollers. A tiltable roller carrier is removably attached to the platform adjacent an edge and is tiltable from a position substantially horizontal to the platform to a position at an angle to the platform surface with one roller tilted downwardly towards the water surface and at least a second roller elevated above the platform.

It would be apparent to those of ordinary skill in the art that many modifications can be made to the embodiment illustrated for example, the second frame instead of being pivotally attached to the frame 21 could be telescopically attached to it such that instead of folding, it could collapse longitudinally. It would be apparent that a greater number of rollers could be provided and that if additional outrigger rollers are necessary, they could be provided, for example, to be attached to rails 22*a* 23*a*. The positioning and type of winch 80 is for illustrative purposes only and it would be understood that the winch can be a permanent fixture of the boat or could be detachably carried by the platform or otherwise. The winch is not necessary except in the case of heavy auxiliary watercraft. While I have shown the use of a shot pin and socket interconnection, it will be readily apparent to those of ordinary skill in the art that many other types of quick securing connections could be utilized. For example, in place of the sockets illustrated, a hook attachment could be provided and the pins could be replaced with, for example, over center lever actuated draw hooks.

What is claimed is:

1. A watercraft cradle adapted to be mounted on a stern platform of a boat comprising: a first cradle member having a plurality of parallel watercraft carriable rollers spaced along the length of the member, a second cradle member having at least one watercraft carriable roller spaced along the length of the second cradle member from the rollers of the first cradle member, the first cradle member attached to the second cradle member to extend lengthwise of the first cradle member, a roller support member carrying a plurality of rollers, a first attachment member adapted to be attached to the platform to removably carry the roller support member at an edge of the platform, independent of and spaced lengthwise of the cradle members, and a plurality of second attachment members adapted to be attached to the platform spaced from the first attachment member to removably secure the first cradle member to the platform.

2. A cradle of claim 1 wherein the second cradle member is moveable with respect to the first cradle member from an extendable watercraft supporting condition to a more compact storage condition.

3. A watercraft cradle according to claim 2 wherein the first attachment member comprises a shoe into which a portion of the roller support member can slide.

4. The cradle of claim 2 wherein the second cradle member is pivotally attached to the first cradle member.

5. A watercraft supporting cradle assembly for attachment at the surface of a horizontally extending platform at the stem of a boat comprising a first cradle member having a first frame rotatably supporting a plurality of spaced apart first rollers, the frame including side rails supporting the rollers, frame supporting members affixed to the frame, at least one outrigger arm carried by one of the side rails projecting outwardly of the one side rail and terminating in a watercraft supporting roller positioned to contact an underside of the watercraft, a second frame member movably affixed to the first frame member and including second side rails, at least one additional roller carried by the second frame member parallel to the first rollers, the second frame member movable from and an extended watercraft supporting position to a collapsed storage position, a plurality of securing members affixed to the platform, and a plurality of cooperating securing members carried by the first frame for detachably securing the first frame to the platform.

6. The cradle of 5 wherein the connection between the first frame and the second frame is a pivotal connection adjacent an end of the first frame whereby the second frame may be rotated from an extended position longitudinally extending from the first frame to a storage position in which the second frame does not substantially extend longitudinally from the first frame.

7. The cradle of claim 6 wherein the side rails of the first frame are interconnected by structural members and the cooperating securing members comprise pins projecting from the structural members receivable in securing member sockets attached to the platform.

8. The cradle of claim 5 including a roller carrier carried by the platform at an edge of the platform longitudinally spaced from the first frame, the roller carrier including a frame structure carrying third and fourth spaced apart parallel rollers parallel with the rollers of the first frame when the roller carrier is affixed to the platform, the roller carrier tiltably attached to the platform with the third roller positioned beyond the edge of the platform, the roller carrier tiltable to a loading position with the third roller below the level of the platform surface at a loading position and tiltable to a storage position with the first roller at a second position at a level at, or above, the platform surface.

9. An auxiliary watercraft cradle adapted to be carried on a platform of a boat comprising: first and second frame members alignable longitudinally of each other with each frame member carrying at least one roller member extending transversely, the roller members positioned to cradle and support, an auxiliary watercraft on the frame members, the second frame member being collapsible with respect to the first frame member whereby the first and second frame members may be positioned in extended watercraft support position and in collapsed position, the collapsed position having a longitudinal combined length less than the longitudinal combined length of the first and second frame members when in the extended watercraft supporting position, a third frame member spaced from the first and second frame members and pivotal with respect thereto, the third frame member carrying at least one roller.

10. The cradle of claim 9 wherein the second frame member is pivotally attached to the first frame member and is rotatable from the extended watercraft supporting position to the collapsed position.

11. The cradle of claim 10 wherein the first frame carriers carries a plurality of roller members and the second frame member carriers carries at least one roller member, the rollers extending parallel to one another and being longitudinally spaced from one another when the frame members are in the extended watercraft supporting position.

* * * * *